US006783660B2

(12) United States Patent
Dahlberg et al.

(10) Patent No.: US 6,783,660 B2
(45) Date of Patent: Aug. 31, 2004

(54) MULTIPLE HYDROPROCESSING REACTORS WITH INTERMEDIATE FLASH ZONES

(75) Inventors: Arthur J. Dahlberg, Benicia, CA (US); Jerome F. Mayer, Novato, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 220 days.

(21) Appl. No.: 10/001,737

(22) Filed: Oct. 25, 2001

(65) Prior Publication Data

US 2003/0085152 A1 May 8, 2003

(51) Int. Cl.[7] ..... C10G 65/00

(52) U.S. Cl. ..... 208/58; 208/59; 208/106; 208/108

(58) Field of Search ..... 208/58, 59, 106, 208/108

(56) References Cited

U.S. PATENT DOCUMENTS 4,082,647 A 4/1978 Hutchings et al. ..... 208/78
4,197,184 A 4/1980 Munro et al. ..... 208/89
5,705,052 A 1/1998 Gupta ..... 208/57
5,720,872 A 2/1998 Gupta ..... 208/57
6,017,443 A 1/2000 Buchanan ..... 208/210
6,103,104 A 8/2000 Gupta ..... 208/210
6,106,695 A 8/2000 Kalnes et al. ..... 208/59

*Primary Examiner*—Walter D. Griffin
*Assistant Examiner*—James Arnold, Jr.
(74) *Attorney, Agent, or Firm*—Penny L. Prater

(57) ABSTRACT

The instant invention comprises a hydroprocessing method having at least two stages. The first stage employs a hydroprocessing catalyst which may contain hydrotreating catalyst, hydrocracking catalyst, or a combination of both. The second stage is limited to hydrocracking. Conversion in the second stage may be improved by the addition of multiple reaction zones for hydrocracking, with flash separation zones between the stages. Middle distillate yield is thereby increased and the volume of the recycle stream is reduced. This invention reduces the need for equipment which would normally be required for a large recycle stream.

14 Claims, 2 Drawing Sheets

MULTIPLE HYDROPROCESSING REACTORS WITH INTERMEDIATE FLASH ZONES

FIELD OF THE INVENTION

This invention relates to hydrocracking, and more particularly to second stage hydrocracking employing multiple reaction zones.

BACKGROUND OF THE INVENTION

Fuel demands are increasing worldwide. The fuels produced must meet stringent standards concerned with environmental quality. The most abundant feedstocks currently available are relatively heavy, such as vacuum gas oil and Fischer-Tropsch streams. Hydrocracking is used to convert heavy hydrocarbon feedstocks into lighter materials which may be used to make middle distillate products.

Hydrocracking is typically performed in one or more staged hydrocracking units that can be independent reactors or combined into multi-staged reactors. All hydrocracking processes aim to maximize yield and minimize recycle volume. In most cases, however, yield maximization results in increased recycle, and vice versa.

U.S. Pat. No. 5,705,052 discloses a process for hydroprocessing liquid petroleum and chemical streams in a single reaction vessel containing two or more hydroprocessing reaction stages. Both feedstock and treat gas flow co-currently in the reaction vessel. The whole partially converted hydrocarbon effluent passes to the next reaction zone after being stripped of its "dissolved gaseous material".

U.S. Pat. Nos. 5,720,872 and 6,103,104 are variations of the process described in U.S. Pat. No. 5,705,052. In U.S. Pat. No. 5,720,872, the major difference is the addition of a multi-staged stripper in a single stripper vessel. U.S. Pat. No. 6,103,104 employs the concept of interbed quench between the hydroprocessing stages.

U.S. Pat. No. 6,017,443 discloses a process for catalytic hydroprocessing, in which a feedstock is introduced at the top of the lower reaction zone for downward flow through and reaction with the catalyst therein. In one embodiment, a partially reacted liquid effluent is pumped from the lower reaction zone to the top of the upper reaction zone for downward flow through and reaction with the catalyst in that zone. The recycle is not fractionated into product and unconverted material prior to recycling, however.

U.S. Pat. No. 4,082,647 discloses a hydrocracking process with two reactors operating in parallel rather than in series. Two different feedstocks may be hydrocracked to maximize distillate production. The second feed is mixed with the vaporous phase from separation of effluent from the conversion of the first feedstock.

U.S. Pat. No. 4,197,184 discloses a conventional multiple-stage process for hydrorefining and hydrocracking a heavy hydrocarbonaceous charge stock. In the process, hydrocracked effluent is admixed with hydrorefined effluent and the combination separated into a hydrogen rich vaporous stream and normally liquid material. The cooled vapor stream is then used as a source of hydrogen and as a quench fluid for both the hydrorefining reaction zone and the hydrocracking reaction zone.

U.S. Pat. No. 6,106,695 discloses a process having more than one hydrocracking reaction zone which contains hydrocracking catalyst, wherein the catalyst is rejuvenated or reactivated while the process unit remains on-stream by the periodic exposure of partially spent catalyst to hot recycle gas containing hydrogen. The reactors in this process operate in parallel rather than in series.

SUMMARY OF THE INVENTION

The instant invention comprises a hydroprocessing method having at least two stages. The first stage employs a hydroprocessing catalyst which may contain hydrotreating catalyst, hydrocracking catalyst, or a combination of both. The second stage employs a series of fixed bed reaction zones, with feed and hydrogen in co-current flow, with inter-bed removal of gas and products. Gas and product removal occur in a flash separation zone in which hydrogen preferably enters countercurrently.

The process of the instant invention maximizes middle distillate yield while minimizing the volume of recycle. Per-pass conversion is defined as fresh feed converted in a stage divided by total feed to a stage. The per-pass conversion rate in each reactor vessel remains low, 40% or less, while the overall conversion rate is 60% or greater.

The process of this invention provides economy in equipment employed. Single bed reactors, which are smaller, have lower capacity, and are easier to maintain than multiple bed reactors, may be used. The use of small, single bed reactors provides flexibility in second stage operation. They are of simple design and do not require quench gases or liquids. This promotes economic operation.

The hydroprocessing method of the instant invention, which has at least two reaction stages, comprises the following steps:

(a) passing a hydrocarbon feed into a first reaction stage, which is maintained at hydroprocessing conditions, where it is contacted with a catalyst in a fixed bed and at least a portion of the feed is converted;
(b) combining the effluent of step (a) with product material from the second reactor stage and passing the combined stream to a separation zone;
(c) separating the stream of step (b) into an unconverted liquid effluent and at least one converted stream comprising products having a boiling point below that of the feed;
(d) passing the unconverted liquid effluent from step (c) to a second reaction stage, said stage comprising a plurality of reaction zones, wherein each zone is maintained at hydrocracking conditions and separation occurs between each zone;
(e) contacting the feed in the first reaction zone of step (d) with a catalyst in a fixed bed, thereby converting at least a portion of the feed;
(f) separating the effluent of step (e) into an unconverted liquid effluent, and a hydrogen-rich converted stream;
(g) recycling the hydrogen-rich converted stream of step (f) to combine with the effluent of step (a);
(h) passing the unconverted liquid effluent from step (f) to a second reaction zone of the second stage, the zone being maintained at hydrocracking conditions;
(i) contacting the feed in the second reaction zone of step (h) with a catalyst in a fixed bed, thereby converting at least a portion of the feed;
(j) fractionating the effluent of step (i) to produce gas, naphtha, and one or more middle distillate product streams, unconverted material being recycled to step (d).

DETAILED DESCRIPTION OF THE PREFERRED EMBODIMENTS

The instant invention is directed to a hydroprocessing method which is particularly useful in the second stage hydrocracking step of integrated processes such as those disclosed in U.S. Pat. No. 6,179,995 (09/227,235), an integrated process for hydroconverting a residuum feedstock.

Figure 1:
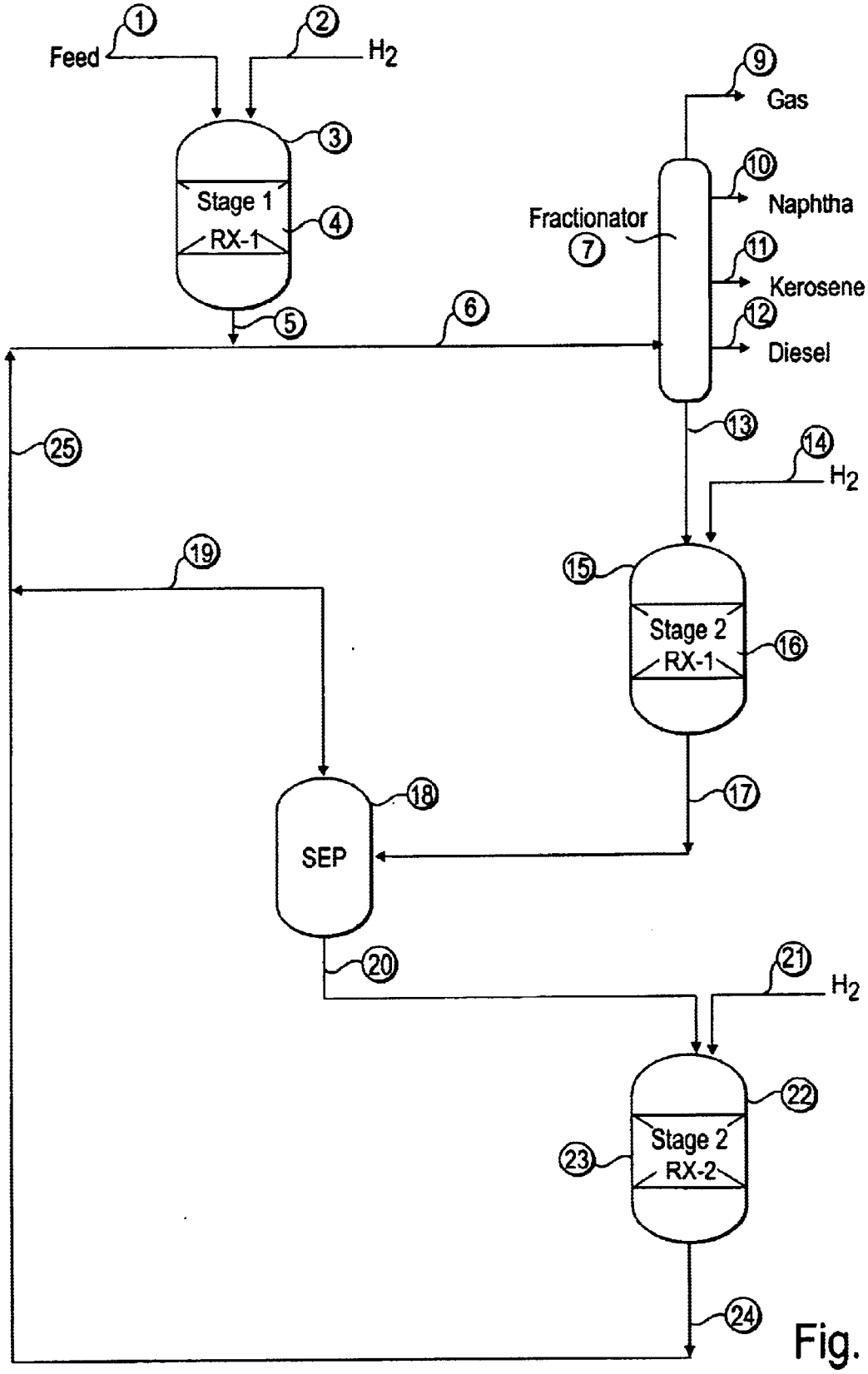
FIG. 1 illustrates a schematic flow diagram of the instant invention. It is a schematic of a two-stage hydrocracker. The second stage possesses at least two reaction zones.

FIG. 1 illustrates a hydrocracking process in which there are at least two fixed bed reaction zones in series. Following each fixed bed reaction zone (prior to the last one in the series) is an intermediate flash zone for separation of converted materials from unconverted materials. In the fixed bed reaction zones, hydrogen is injected preferably in a co-current direction to the fixed bed effluent.

In FIG. 1, the feedstock stream 1 enters the first hydroprocessing stage 3 (which comprises at least one fixed bed reactor), along with hydrogen stream 2. Streams 1 and 2 enter the top of the reactor and flow downward, contacting the fixed catalyst bed 4. The effluent 5 combines with product stream 25 to form stream 6. Stream 6 enters the fractionator 7, where it is separated into product streams, which are further discussed below. Product streams include gas 9, naphtha 10, kerosene 11, and diesel 12. The unconverted material, stream 13 boils above typically 700° F. It passes to the first reaction zone of stage 2, reactor 15. Stream 13 and 14 (the hydrogen stream) flow downward through fixed hydrocracking catalyst bed 16. The effluent of reactor 15, stream 17 passes to separation zone 18. Product, which boils below 700° F., is removed in stream 19. Stream 20, which contains unconverted material, enters the second reaction zone of stage 2, reactor 22, along with stream 21, which comprises hydrogen. Streams 20 and 21 flow downwardly through fixed hydrocracking catalyst bed 23. Stream 24, the effluent of reactor 22, combines with stream 19 to form stream 25.

The per-pass conversions in both reactors 15 and 22 are typically between 30% and 40%.

Feeds

A wide variety of hydrocarbon feeds may be used in the instant invention. Typical feedstocks include any heavy or synthetic oil fraction or process stream having a boiling point above 392° F. (200° C.). Such feedstocks include vacuum gas oils, demetallized oils, deasphalted oil, Fischer-Tropsch streams, FCC and coker distillate streams, heavy crude fractions, etc. Typical feedstocks contain from 100–5000 ppm nitrogen and from 0.2–5 wt. % sulfur.

Products

The hydrocracking process of this invention is especially useful in the production of middle distillate fractions boiling in the range of about 250–700° F. (121–371° C.). A middle distillate fraction is defined as having a boiling range from about 250 to 700° F. The term "middle distillate" includes the diesel, jet fuel and kerosene boiling range fractions. The kerosene or jet fuel boiling point range refers to the range between 280 and 525° F. (138–274°). The term "diesel boiling range" refers to hydrocarbons boiling in the range from 250 to 700° F. (121–371° C.). Gasoline or naphtha normally boils in the range below 400° (204° C.). Boiling ranges of various product fractions recovered in any particular refinery will vary with such factors as the characteristics of the crude oil source, local refinery markets and product prices.

Conditions

Hydroprocessing conditions is a general term which refers primarily in this application to hydrocracking or hydrotreating, preferably hydrocracking.

Hydrotreating conditions include a reaction temperature between 400° F.–900° F. (204° C.–482° C.), preferably 650° F.–850° F. (343° C.–454° C.); a pressure between 500 to 5000 psig (pounds per square inch gauge) (3.5–34.6 MPa), preferably 1000 to 3000 psig (7.0–20.8 MPa); a feed rate (LHSV) of 0.5 $hr^{-1}$ to 20 $hr^{-1}$ (v/v); and overall hydrogen consumption 300 to 2000 scf per barrel of liquid hydrocarbon feed (53.4–356 $m^3/m^3$ feed).

Typical hydrocracking conditions include a reaction temperature of from 400° F.–950° F. (204° C.–510° C.), preferably 650° F.–850° F. (343° C.–454° C.). Reaction pressure ranges from 500 to 5000 psig (3.5–34.5 MPa), preferably 1500–3500 psig (10.4–24.2 MPa). LHSV ranges from 0.1 to 15 $hr^{-1}$ (v/v), preferably 0.25–2.5 $hr^{-1}$. Hydrogen consumption ranges from 500 to 2500 scf per barrel of liquid hydrocarbon feed (89.1–445$m^3$ $H_2/m^3$ feed).

Catalyst

A hydroprocessing zone may contain only one catalyst, or several catalysts in combination.

The hydrocracking catalyst generally comprises a cracking component, a hydrogenation component and a binder. Such catalysts are well known in the art. The cracking component may include an amorphous silica/alumina phase and/or a zeolite, such as a Y-type or USY zeolite. Catalysts having high cracking activity often employ REX, REY and USY zeolites. The binder is generally silica or alumina. The hydrogenation component will be a Group VI, Group VII, or Group VIII metal or oxides or sulfides thereof, preferably one or more of molybdenum, tungsten, cobalt, or nickel, or the sulfides or oxides thereof. If present in the-catalyst, these hydrogenation components generally make up from about 5% to about 40% by weight of the catalyst. Alternatively, noble metals, especially platinum and/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst. If noble metals are employed, poisoning is avoided due to the use of small reactors and the constant influx of hydrogen.

Hydrotreating catalyst, if used, will typically be a composite of a Group VI metal or compound thereof, and a Group VIII metal or compound thereof supported on a porous refractory base such as alumina. Examples of hydrotreating catalysts are alumina supported cobalt-molybdenum, nickel sulfide, nickel-tungsten, cobalt-tungsten and nickel-molybdenum. Typically, such hydrotreating catalysts are presulfided.

EXAMPLES

FIG. 1 is a schematic of this invention. The effluent of a first-stage hydroprocessor passes to a fractionator. The unconverted portion of the first stage hydroprocessor passes to a second-stage hydrocracker. The second-stage hydrocracker comprises multiple reaction zones which are connected in series, with interstage separation zones. Unconverted material removed from each separation zone is passed to the next reaction zone and product is fractionated into middle distillate products and a recycle stream.

Figure 2:
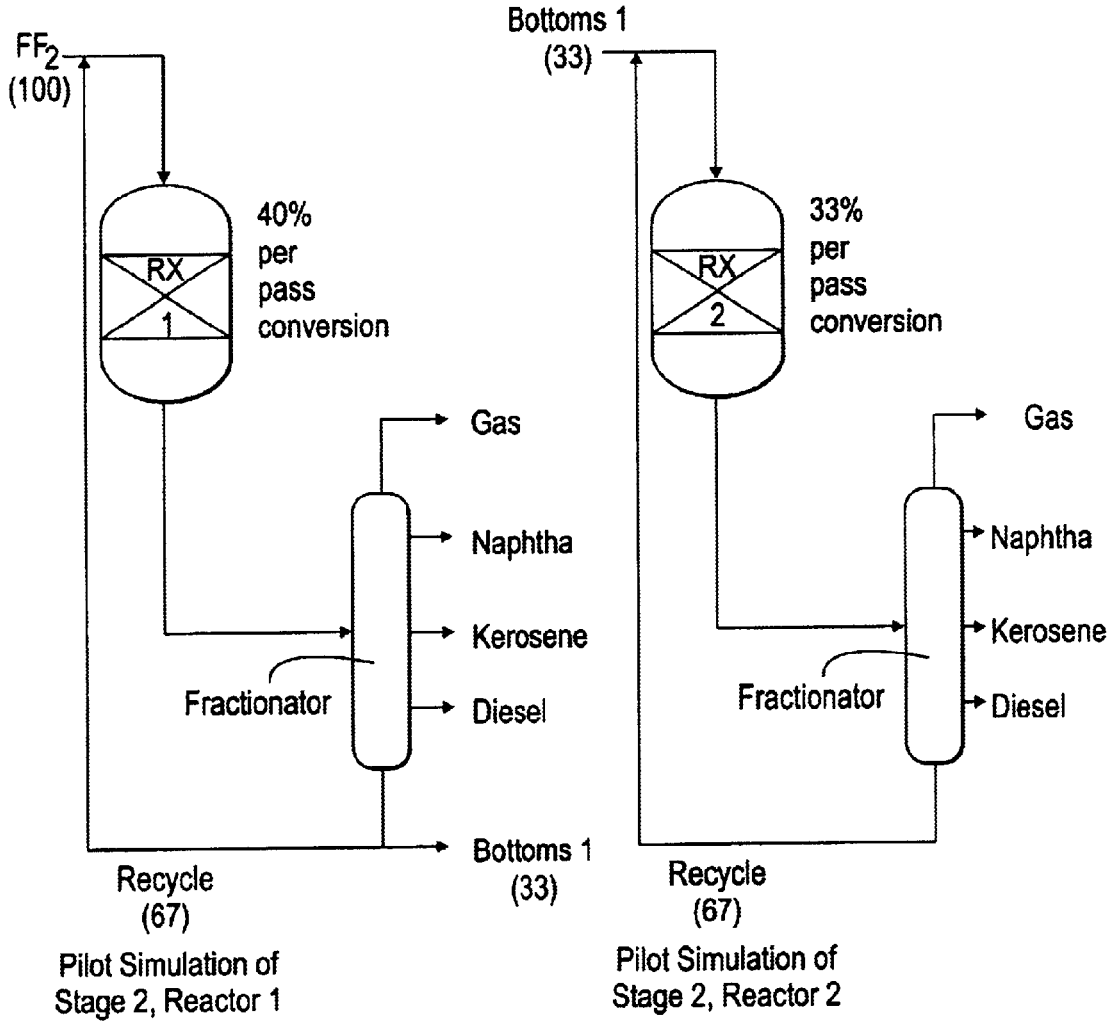
FIG. 2 illustrates the pilot plant simulations of two second-stage reaction zones in series.

FIG. 2 represents a pilot plant simulation of this invention. The feed to the second-stage hydrocracker is a hydrotreated Middle East vacuum gas oil. Fresh feed (represented by 100 units) joins with recycle (represented as 67 units) and passes to reaction zone 1. 40% per-pass conversion (67/167) occurs, and products are removed by fractionation. Bottoms (33 units) are passed to reaction zone 1, where it is combined with recycle from reaction zone 2 (67 units) prior to entry into the reaction zone. 33% (33/100) of the material is converted and fractionated as products. Per-pass conversion=fresh feed converted in a stage/total feed to a stage.

The Table below presents the conditions employed in this example. The recycle cut point is 700° F. The hydrogen partial pressure is 2100 psia. Three different scenarios are depicted. In the first case, a standard second-stage hydrocracking mode is employed, rather than the mode of this invention. The liquid hourly space velocity (LHSV) is 1 $hr^{-1}$. The per-pass conversion is 60%. The catalyst employed is an amorphous, base metal catalyst. In the second case, a zeolite loaded with noble metal is employed as the catalyst and the LHSV is 2 $hr^{-1}$. A standard second-stage mode is also employed, with 60% per-pass conversion.

The third case depicts a second-stage hydrocracker with more than one reaction zone, as in the instant invention. The same noble metal/zeolite catalyst as in the second case is employed. In the third case, the individual per-pass conversions for each reaction zone are 40% and 33%, respectively, while the overall per-pass conversion is 60%. The LHSV is 2 $hr^{-1}$.

As the Table below illustrates, second-stage distillate yield is greatest when the third case is employed.

COMPARISON OF SECOND-STAGE ISOCRACKING YIELDS
HDT Middle East VGO, 700° F. Recycle Cut Point, ~2100 psia $H_2$

| Case | 1 | 2 | 3 |
|---|---|---|---|
| Catalyst | Amorphous Base Metal | NMZ (Noble metal zeolite) | NMZ (Noble metal zeolite) |
| Conditions | | | |
| LHSV, 1/hr | 1.0 | 2.0 | 2.0 |
| PPC, % | 60 | 60 | 40* |
| Mode | Standard | Standard | Two-stages with intermediate separation |
| Yields | | | |
| $C_{4-}$ | 4.4 | 3.4 | 2.5 |
| $C_5$–250° F., LV % | 22.6 | 22.0 | 16.4 |
| 250–550° F. | 51.3 | 60.3 | 56.4 |
| 550° F.–700° F. | 34.0 | 26.9 | 35.1 |
| 250–700° F. | 85.3 | 87.2 | 91.5 |

*RecycIe liquid rate of 60% PPC.

What is claimed is:

1. The hydroprocessing method of the instant invention, which has at least two reaction stages, comprises the following steps:

(a) passing a hydrocarbon feed into a first reaction stage, which is maintained at hydroprocessing conditions, where it is contacted with a catalyst in a fixed bed and at least a portion of the feed is converted;

(b) combining the effluent of step (a) with product material from a second reaction stage and passing the combined stream to a separation zone;

(c) separating the stream of step (b) into an unconverted liquid effluent and at least one converted stream comprising products having a boiling point below that of the feed;

(d) passing the unconverted liquid effluent from step (c) to a second reaction stage, said stage comprising a plurality of reaction zones, wherein each zone is maintained at hydrocracking conditions and separation occurs between each zone;

(e) contacting the feed in the first reaction zone of step (d) with a catalyst in a fixed bed, thereby converting at least a portion of the feed;

(f) separating the effluent of step (e) into an unconverted liquid effluent, and a hydrogen-rich converted stream;

(g) recycling the hydrogen-rich converted stream of step (f) to combine with the effluent of step (a);

(h) passing the unconverted liquid effluent from step (f) to a second reaction zone of the second stage, the zone being maintained at hydrocracking conditions;

(i) contacting the feed in the second reaction zone of step (h) with a catalyst in a fixed bed, thereby converting at least a portion of the feed;

(j) fractionating the effluent of step (i) to produce gas, naphtha, and one or more middle distillate product streams, unconverted material being recycled to step (d).

2. The process of claim 1(*d*), wherein the inlet temperature of each reaction zone in the second stage subsequent to the first reaction zone is lower than the previous one and the outlet temperature of each reaction zone subsequent to the first reaction zone is lower than the previous one.

3. The process of claim 2, wherein the average reaction temperature of each reaction zone subsequent to the first reaction zone is at least 50° F. lower than the average reaction temperature of the previous one.

4. The process of claim 1, wherein the catalyst of each reaction zone of the second stage of step (d) is a hydrocracking catalyst.

5. The process of claim 4, wherein each of the reaction zones of the second stage is operated under hydrocracking conditions including temperatures in the range from about 400–950° F. (204–510° C.), reaction pressure in the range from 500 through 5000 psig (3.5–34.5 MPa), LHSV of 0.1 to 15 $hr^{-1}$, and hydrogen consumption of 500 through 2500 scf per barrel of liquid hydrocarbon feed (89.1–445 $m^3$ $H_2$ feed).

6. The process of claim 5, wherein more preferred hydrocracking conditions include a temperature range from 650–850° F. (343° C.–454° C.), reaction pressure from 1500 psig through 3500 psig (10.4–24.2 MPa) and LHSV 0.25 through 2.5 $hr^{-1}$, and hydrogen consumption of 500 through 2500 scf per barrel of liquid hydrocarbon feed (89.1–445 $m^3$ $H_2$ feed).

7. The process of claim 1, wherein the unconverted effluent comprises hydrocarbons which boil above 700° F.

8. The process of claim 1, wherein the converted stream comprises hydrocarbons boiling below 700° F.

9. The process of claim 1, wherein the overall hydrocarbon conversion is at least 60% and the hydrocarbon conversion for each reaction zone is in the range from 20% to 40%.

10. The process of claim 1, wherein the converted stream from each reaction zone is continuously combined and fractionated into at least one fuel product.

11. The process of claim 10, wherein the preferred fuel product is diesel.

12. The process of claim 10, wherein the preferred fuel product is jet fuel.

13. The process of claim 10, wherein the preferred fuel product is naphtha.

14. The process of claim 1, wherein the feed is subjected to a preliminary hydrotreating step.

* * * * *